US011333169B2

(12) United States Patent
Strock et al.

(10) Patent No.: US 11,333,169 B2
(45) Date of Patent: May 17, 2022

(54) FAN BLADES WITH ABRASIVE TIPS

(71) Applicant: United Technologies Corporation, Farmington, CT (US)

(72) Inventors: Christopher W. Strock, Kennebunk, ME (US); Changsheng Guo, South Windsor, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 51 days.

(21) Appl. No.: 16/565,269

(22) Filed: Sep. 9, 2019

(65) Prior Publication Data

US 2020/0003225 A1 Jan. 2, 2020

Related U.S. Application Data

(63) Continuation of application No. 14/509,780, filed on Oct. 8, 2014, now Pat. No. 10,408,224.

(Continued)

(51) Int. Cl.
*F01D 5/28* (2006.01)
*F04D 29/38* (2006.01)

(Continued)

(52) U.S. Cl.
CPC ..... *F04D 29/388* (2013.01); *F01D 5/286* (2013.01); *F01D 5/288* (2013.01); *F01D 11/122* (2013.01);

(Continued)

(58) Field of Classification Search
CPC ..... F04D 29/388; F04D 19/002; F01D 5/286; F01D 5/288; F01D 11/122;

(Continued)

(56) References Cited

U.S. PATENT DOCUMENTS 4,594,761 A * 6/1986 Murphy ..... B29D 99/0028 29/889.71
5,141,400 A * 8/1992 Murphy ..... F04D 29/324 416/204 A (Continued)

FOREIGN PATENT DOCUMENTS

EP 1391537 A1 * 2/2004 ..... C23C 26/02
EP 2540961 A2 * 1/2013 ..... F01D 11/122

OTHER PUBLICATIONS http://www.espimetals.com/index.php/technical-data/334-understanding-mesh-sizes.*
http://www.sigmaaldrich.com/chemistry/stockroom-reagents/learning-center/technical-library/particle-size-conversion.html.*
European Search Report for Application No. 19 21 3613.

*Primary Examiner* — Aaron R Eastman
(74) *Attorney, Agent, or Firm* — Cantor Colburn LLP

(57) ABSTRACT

A fan blade for a gas turbine engine is disclosed. The disclosed fan blade includes an airfoil having a leading edge, a trailing ling edge, a convex side, a concave side and a distal tip. The leading edge, trailing edge, convex side and concave side of the airfoil is at least partially coated with an erosion resistant coating. The distal tip of the airfoil is coated with a bonded abrasive coating. The bonded abrasive coating engages the abradable coating disposed on the fan liner and, because of its low thermal conductivity, reduces heat transfer to the distal tip of the fan blade. The reduction in heat transfer to the distal tip of the fan blade preserves the integrity of erosion resistant coatings that may be applied to the body or the airfoil of the fan blade.

20 Claims, 3 Drawing Sheets

Related U.S. Application Data

(60) Provisional application No. 61/930,523, filed on Jan. 23, 2014.

(51) Int. Cl.
*F04D 19/00* (2006.01)
*F01D 11/12* (2006.01)

(52) U.S. Cl.
CPC ..... *F04D 19/002* (2013.01); *F05D 2240/31* (2013.01); *F05D 2300/211* (2013.01); *F05D 2300/2282* (2013.01); *F05D 2300/43* (2013.01); *F05D 2300/434* (2013.01); *F05D 2300/44* (2013.01); *Y10T 156/10* (2015.01)

(58) Field of Classification Search
CPC ..... F05D 2240/31; F05D 2300/211; F05D 2300/2282; F05D 2300/43; F05D 2300/434; F05D 2300/44; Y10T 156/10
See application file for complete search history.

(56) References Cited

U.S. PATENT DOCUMENTS

| | | | | |
|---|---|---|---|---|
| 5,476,363 | A | 12/1995 | Freling et al. | |
| 5,486,096 | A * | 1/1996 | Hertel | F01D 5/288 416/224 |
| 5,551,840 | A | 9/1996 | Benoit et al. | |
| 2010/0329875 | A1 | 12/2010 | Kray et al. | |
| 2012/0301292 | A1 | 11/2012 | Deal et al. | |
| 2014/0010663 | A1 | 1/2014 | Parkos et al. | |
| 2015/0204347 | A1 | 7/2015 | Strock et al. | |

* cited by examiner

FAN BLADES WITH ABRASIVE TIPS

CROSS-REFERENCE TO RELATED APPLICATION

This Application is a Continuation of a Non-provisional Ser. No. 14/509,780 filed Oct. 8, 2014 which is a non-provisional patent application claiming priority under 35 USC § 11 9(e) to U.S. Provisional Patent Application Ser. No. 61/930,523 filed on Jan. 23, 2014 the disclosure of which is incorporated herein by reference in its entirety.

BACKGROUND

Disclosed herein are fan blades for gas turbine engines and methods of manufacturing such fan blades. The disclosed fan blades include low thermal conductivity abrasive-coated tips for engaging an abradable liner that surrounds the fan blades.

FIG. 1 illustrates part of a turbofan gas turbine engine 10. The engine 10 may include a nacelle 11, which may be lined with a fan case 12 that may include a liner 13 that surrounds the distal tips 14 of the fan blades 15. The fan blades 15 may each include a leading edge 16, a trailing edge 17 and a base or root 18, which may be coupled to a rotor 21. The rotor 21 may be coupled to a low-pressure shaft 22 via a fan shaft 23 and fan shaft extension 24. Also shown in FIG. 1 is a low-pressure compressor 25, an annular bypass duct 26 and part of the high-pressure compressor 27. Downstream components such as a combustor and high and low-pressure turbines are not shown.

The liner 13 may be coated with an abradable coating that is not shown in FIG. 1. Abradable coatings may be used in gas turbine engines in the fan section where a minimal clearance is needed between the blade tips 14 and the liner 13. Abradable coatings may also be used in the compressor and turbine sections. The abradable coating may be designed to wear when engaged by the more abrasive fan blade tips 14, thereby reducing or limiting wear to the fan blade tips 14. By using abradable coatings on the liners 13, closer clearances between the blade tips 14 and the liner 13 may be employed, which results in improved efficiency. Further, as the abradable coatings wear, the coatings can act to automatically adjust the clearance between the liner 13 and blade tips 14, in-situ. Typical abradable coatings include epoxy with a filler, such as glass microballoons, which reduce density and weight and also provide a low thermal conductivity coating.

Aluminum fan blades 15 for gas turbine engines 10 may be coated with an erosion resistant coating, such as polyurethane, to protect the aluminum. Such erosion resistant coatings have also been applied to composite fan blades as well. One problem associated with polyurethane coatings is their tendency to degrade if the fan blade gets too hot. More specifically, as a hard-anodized fan blade tip 14 rubs against the abradable coating of the liner 13, frictional heating causes the blade tip 14 to get hot enough to degrade the polyurethane coating of the fan blade 14.

Accordingly, there is a need for improved fan blades that do not get hot enough to damage erosion resistant coatings during use.

BRIEF DESCRIPTION

In one aspect, a fan blade for a as turbine engine is disclosed. The disclosed fan blade may include an airfoil that may include a distal tip. The airfoil may be partially coated with an erosion resistant coating. The distal tip may be coated with a bonded abrasive coating.

In another aspect, a disclosed fan blade may include an airfoil that may include a leading edge, a trailing edge, a convex side, a concave side and a distal tip. The leading edge, trailing edge, convex side and concave side of the airfoil may be at least partially coated with an erosion resistant coating. Further, the distal tip of the airfoil may be coated with a bonded abrasive coating.

In another aspect, a method for fabricating a fan blade is disclosed. The disclosed method may include forming an airfoil that includes a distal tip. The method may further include at least partially coating the airfoil with an erosion resistant coating. The method may further include providing a bonded abrasive on a first side of a release carrier. Finally, the method may include pressing the first side of the release carrier onto the distal tip of the airfoil.

In any one or more of the embodiments described above, the bonded abrasive coating may include one or snore bonding agents selected from the group consisting of: epoxy, polyimide, polyurethane, cyanoacrylate, acrylic and combinations thereof.

In any one or more of the embodiments described above, the erosion resistant coating may be a polyurethane.

In any one or more of the embodiments described above, the bonded abrasive coating may include zirconia.

In any one or more of the embodiments described above, the bonded abrasive coating has a thickness ranging from about 4 to about 25 mils.

In any one or more of the embodiments described above, the bonded abrasive coating forms corners on the distal tip of fan blade.

In any one or more of the embodiments described above, the bonded abrasive coating may extend from the distal tip of the fan blade onto portions of the leading and trailing edges and the concave and convex sides of the airfoil. In a further refinement of this concept, the bonded abrasive coating may be rounded as it extends from the distal tip onto portions of the leading and trailing edges and the concave and convex sides of the airfoil. In an alternative refinement, the bonded abrasive coating may form corners as it extends from the distal tip onto portions of the leading and trailing edges and concave and convex sides of the airfoil.

In any one or more of the embodiments described above, the bonded abrasive coating may be rounded as it extends over the distal tip and between the convex and concave sides of the airfoil.

In any one or more of the embodiments described above, the abrasive particles are dispersed within the bonded abrasive coating.

In any one or more of the embodiments described above, the bonded abrasive coating includes a bonding layer disposed on the distal tip of the airfoil and a layer of abrasive particles disposed on the bonding layer, opposite the distal tip of the airfoil.

In any one or more of the embodiments described above, the distal tip of the airfoil may be free of the erosion resistant coating.

BRIEF DESCRIPTION OF THE DRAWINGS

For a more complete understanding of the disclosed methods and apparatuses, reference should be made to the embodiments illustrated in greater detail on the accompanying drawings, wherein.

It should be understood that the drawings are not necessarily to scale and that the disclosed embodiments are sometimes illustrated diagrammatically and in partial views. In certain instances, details which are not necessary fir an understanding of the disclosed methods and apparatuses or which render other details difficult to perceive may have been omitted. It should be understood, of course, that this disclosure is not limited to the particular embodiments illustrated herein.

DETAILED DESCRIPTION

Figure 1:
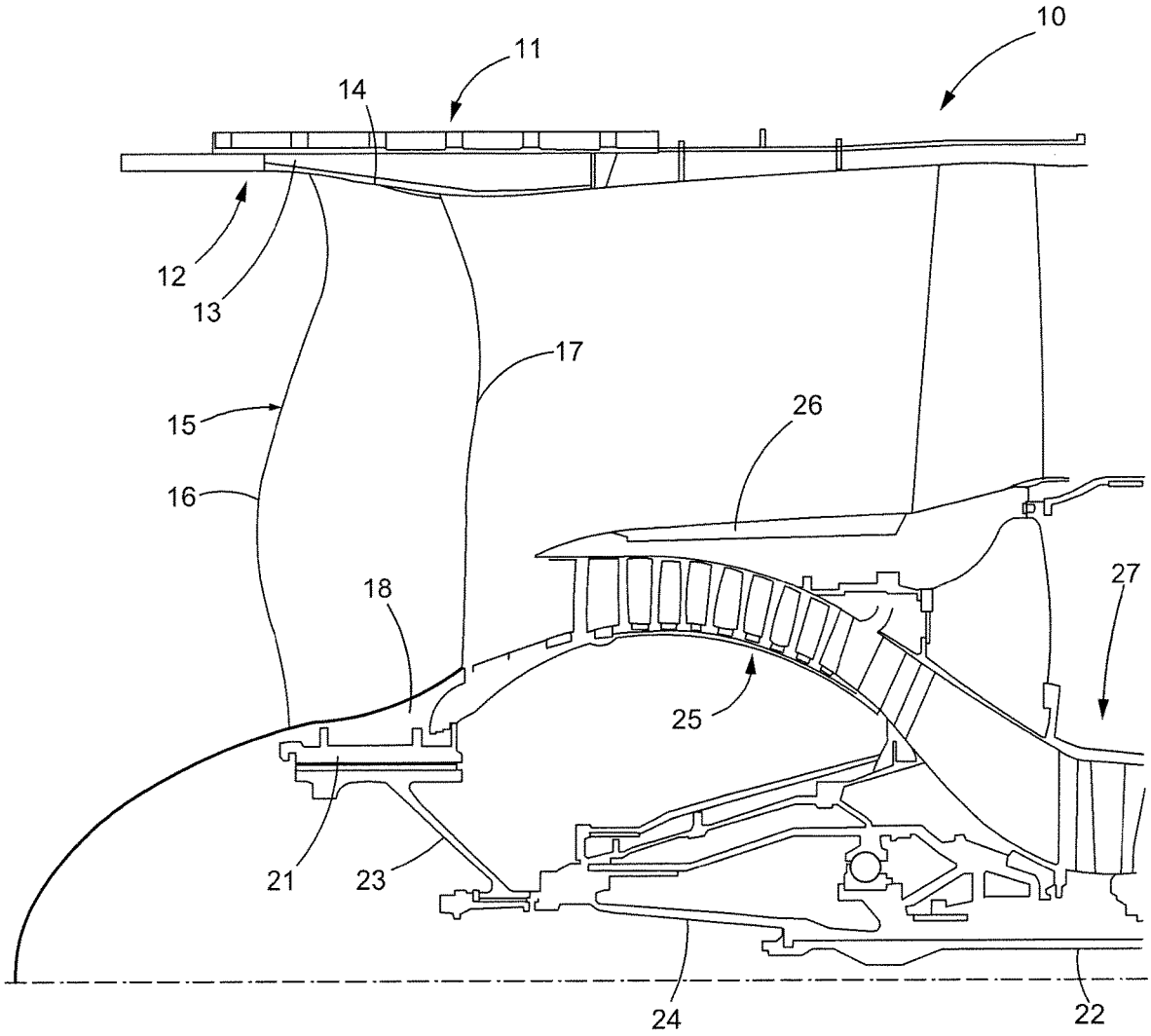
FIG. 1 is a partial sectional view of a turbofan as turbine engine illustrating one of the disclosed fan blades.
Figure 2:
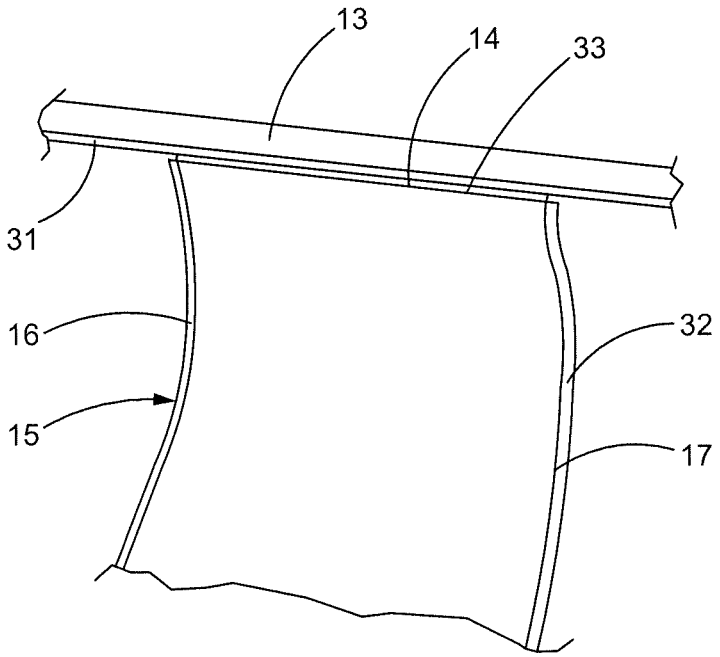
FIG. 2 is a partial side view of a fan blade and a sectional view of a liner and abradable coating disposed on the liner that engages a distal tip of the airfoil.

As noted above, the liner 13 that encircles the fan section of a gas turbine engine 10 may be coated with an abradable coating 31 shown in FIG. 2. Typically, the abradable coating 31 may be an epoxy material with a glass microballoon filler. When a hard distal tip 14 of a fan blade 15 rubs against the abradable coating 31, frictional heating may cause the distal tip 14 of the fan blade 15 to become hot as the abradable coating 31 may have a low thermal conductivity. The frictional heating of the distal tip 14 can be problematic, particularly if the tan blade 15 is coated with an erosion resistant coating 32 as shown in FIG. 2. Such erosion resistant coatings 32 may be polyurethane, which may be degraded if the fan blade 15 gets too hot.

To address this concern, the distal tip 14 of the fan blade 15 may be coated with a bonded abrasive coating 33 as shown in FIG. 2. Instead of the distal tip 14 engaging the abradable coating 31, the bonded abrasive coating 33 engages the abradable coating 31. The bonded abrasive coating 33 may be provided in a variety of forms, some of which are illustrated in FIGS. 3-7.

Figure 3:
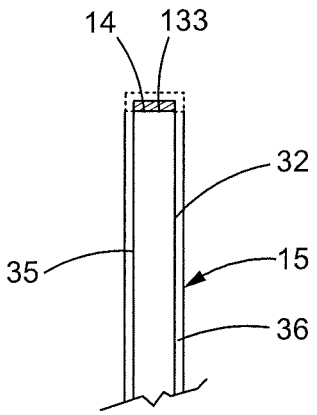
FIG. 3 is a sectional view of a distal tip of an airfoil coated with an erosion resistant coating and a bonded abrasive coating in accordance with one embodiment of this disclosure.

Turning to FIG. 3, a sectional view of a distal tip 14 of a fan blade 15 is shown. The fan blade 15 is coated with an erosion resistant coating 32 as described above. Instead of applying the erosion resistant coating 32 to the distal tip 14 of the fan blade, a bonded abrasive coating 133 is applied to the distal tip 14. The coating 133 may be adhesive based with an abrasive filler.

For example, the bonded abrasive coating may include one or more epoxies, polyimides, polyurethanes, cyanoacrylates, acrylics, etc. and combinations thereof. Suitable abrasive fillers include zirconia, alumina, silica, cubic boron nitride (CBN), various metal alloys and mixtures thereof. One suitable abrasive is sold by Washing Mills under the trademark DURALUM ATZ II W, 220 mesh. More specifically, zirconia having an average particle size of 220 mesh may be effective, although the particle size may vary, as will be apparent to those skilled in the art. Further, FIGS. 3-7 illustrate the concave side 35 and convex side 36 of the airfoil 15. As shown in FIG. 3, the concave side 35 and convex side 36 may be at least partially coated with the erosion resistant coating 32. Further, as illustrated in FIG. 2, the leading and trailing edges 16, 17 may be coated with the erosion resistant coating 32 as well. However, as shown in FIG. 3, the distal tip 14 of the fan blade 15 may not be coated with the erosion resistant coating 32 and, instead, may be coated with the bonded abrasive coating 133. Alternatively, the erosion resistant coating may be applied to the entire fan blade 15, including the distal tip 14, over the bonded abrasive coating 133 as shown in phantom lines in FIG. 3. In the embodiment shown in FIG. 3, the coating 133 is applied just to the distal tip 14 and does not extend around to the concave side 35, convex side 36 or to the leading edge 16 or trailing edge 17.

Figure 4:
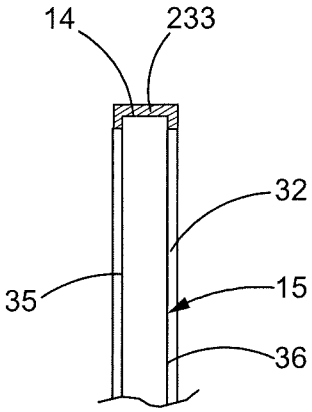
FIG. 4 is a sectional view of a distal tip of an airfoil coated with an erosion resistant coating and a bonded abrasive coating in accordance with a second embodiment of this disclosure.
Figure 5:
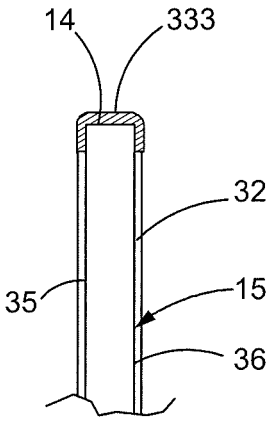
FIG. 5 is a sectional view of a distal tip of an airfoil coated with an erosion resistant coating and a bonded abrasive coating in accordance with a third embodiment of this disclosure.

In contrast, turning to FIG. 4, a bonded abrasive coating 233 is applied to the distal tip 14 of the fan blade 15 as well as portions of the concave side 35, convex side 36, leading edge 16 and trailing edge 17 so that the coating 233 caps or encloses the distal tip of the fan blade 15. The coating 233 may form sharp corners as it extends around to the concave side 35, convex side 36, leading edge 16 and trailing edge 17. In contrast, another bonded abrasive coating 333 is shown in FIG. 5, which also extends around to the concave side 35, convex side 36, leading edge 16 and trailing edge 17. However, the coating 33 forms rounded corners as the coating 333 extends around to the concave side 35, convex side 36, leading edge 16 and trailing edge 17.

Figure 6:
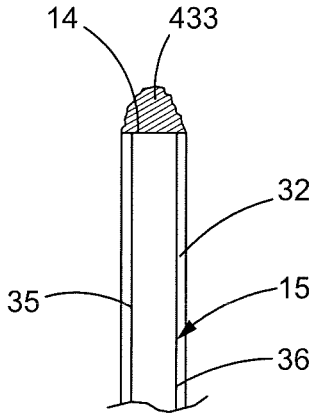
FIG. 6 is a sectional view of a distal tip of an airfoil coated with an erosion resistant coating and a bonded abrasive coating in accordance with a fourth embodiment of this disclosure.

Turning to FIG. 6, in another variation, the distal tip 14 is coated with a bonded abrasive coating 433 that increases in thickness as it extends from the concave side 35 or convex side 36 towards a mid-portion of the distal tip 14 as shown in FIG. 6. The raised area provided by the coating 433 may permit a more localized abrasive contact with the abradable coating 31, which may further reduce the temperature of the distal tip 14. Further, by including a raised middle portion as shown in FIG. 6, the work associated with reducing the thickness of the abradable coating 31 may be distributed more equally to the other fan blades 14. More specifically, while a smaller amount of bonded abrasive coating 433 initially engages the abradable liner 31, the raised middle portions of the coatings 433 wear faster initially, but with a better wear distribution amongst the various fan blades 15. As a result, an average clearance between the distal tips 14 and the abradable liners 31 may be reduced.

Figure 7:
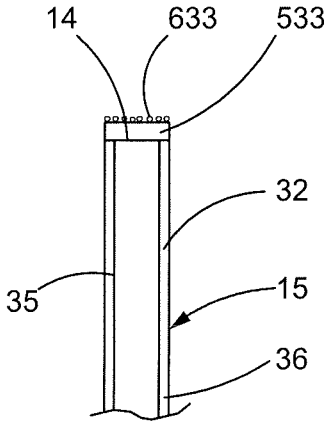
FIG. 7 is a sectional view of a distal tip of an airfoil coated with an erosion resistant coating and a bonded abrasive coating in accordance with a fifth embodiment of this disclosure.

Finally, turning to FIG. 7, a coating 533 disposed on a distal tip 14 may include two parts or phases. Specifically, the coating 533 may be primarily bonding material (e.g., epoxy, polyimide, polyurethane, cyanoacrylate, acrylic, etc.) and in turn, may be coated with one or more layers of abrasive particulate 633. The abrasive particulate 633 may be disposed opposite the primary coating 533 from the distal tip 14 of the fan blade 15. The coating 533 and the abrasive particulate 633 may also help manufacturers provide a reduced tip clearance.

For example, when the longest fan blade 15 rubs first, it exhibits a wear ratio with the abradable coating 31 disposed on the liner 13 and the particulate layer 633 wears first. When the particulate layer 633 is removed due to wear, the relative wear ratio between the bonded abrasive coating 533 and the abradable coating 31 reverses, making the bonding layer 533 abradable, or more prone to wear than the abradable coating 31. The work of any additional cutting or wearing on the abradable liner 31 is then transferred to the next longest blade 115 while the remaining bonding layer 533 prevents contact between the distal tip 14 of the fan blade 15 and the abradable coating 31 disposed on the liner 13. Such a technique may also be applied to aluminum, composite and titanium fan blades 15.

Accordingly, fan blades 15 with distal tips 14 that are coated with an abrasive coating 33, 133, 233, 333, 433, 533/633 are disclosed. The disclosed abrasive coatings 33, 133, 233, 333, 433, 533/633 reduce heating of the distal tips 14 of the fan blades 15 and therefore avoid degradation of erosion resistant coatings 32 that may be applied to the airfoil portions of the fan blades 15. Use of a relatively low modulus binder, such as an epoxy, does not add a significantly affect the fatigue strength of the blade tips 14. The disclosed coatings are useful for aluminum fan blades, composite fan blades and titanium fan blades. Further, the disclosed coatings may also be useful on fan blades made from other materials, as will be apparent to those skilled in the art.

One suitable way to manufacture the disclosed fan blades is to first form the fan blade body or airfoil. After the fan blade is formed, at least part of the leading edge, trailing edge, convex side and concave side of the airfoil may be coated with an erosion resistant coating. The bonded abrasive coating may be applied by first depositing the bonded abrasive onto a first side of a release carrier, such as a piece of release paper. The release carrier, then, may then be pressed onto the distal tip 14 of a fan blade 15 to thereby transfer the bonded abrasive onto the distal tip 14 as a coating. The bonded abrasive coating may be applied before or after the erosion resistant coating.

One suitable way to manufacture the disclosed fan blades is to first form the fan blade body or airfoil. After the fan blade is formed, at least part of the leading edge, trailing edge, convex side and concave side of the airfoil may be coated with an erosion resistant coating. The bonded abrasive coating may be applied by first depositing the bonded abrasive onto a first side of a release carrier, such as a piece of release paper. The release carrier, then, may then be pressed onto the distal tip 14 of a fan blade 15 to thereby transfer the bonded abrasive onto the distal tip 14 as a coating. The bonded abrasive coating may be applied before or after the erosion resistant coating.

While only certain embodiments have been set forth, alternative embodiments and various modifications will be apparent from the above description to those skilled in the art. These and other alternatives are considered equivalents and within the spirit and scope of the present disclosure.

What is claimed:

1. A tan blade comprising: an airfoil including a distal tip, the fan blade being coated with an erosion resistant coating, wherein the erosion resistant coating terminates at a point proximal to the distal tip such that the distal tip is uncoated with the erosion resistant coating, the distal tip being coated with a bonded abrasive coating.

2. The fan blade of claim 1 wherein the bonded abrasive coating includes at least one material selected from the group consisting of: epoxy, polyimide, polyurethane, cyanoacrylate, acrylic and combinations thereof.

3. The fan blade of claim 1, wherein the bonded abrasive coating is only applied to the distal tip.

4. The fan blade of claim 1 wherein the erosion resistant coating is a polyurethane.

5. The fan blade of claim 1 wherein the bonded abrasive coating includes at least one abrasive material selected from the group consisting of zirconia, alumina, silica, cubic boron nitride (CBN), a metal alloy and mixtures thereof.

6. The fan blade of claim 1 wherein the bonded abrasive coating includes.

7. The fan blade of claim 1 wherein the bonded abrasive coating is coated onto the distal tip with a thickness ranging from 4 to 25 mils.

8. The fan blade of claim 1 wherein the distal tip of the airfoil is connected to a leading edge, a trailing edge, a concave side and a convex side, and wherein the bonded abrasive coating extends from the distal tip onto portions of the leading edge, trailing edge, concave side and convex side of the airfoil.

9. The fan blade of claim 1 wherein the distal tip of the airfoil is connected to a leading edge, a trailing edge, a concave side and a convex side, and wherein the bonded abrasive coating is rounded as it extends from the distal tip onto portions of the leading edge, trailing edge, concave side and convex side of the airfoil.

10. The fan blade of claim 1 wherein the distal tip of the airfoil is connected to a leading edge, a trailing edge, a concave side and a convex side, and wherein the bonded abrasive coating forms corners as it extends from the distal tip onto portions of the leading edge, trailing edge, concave side and convex side of the airfoil.

11. The fan blade of claim 1 wherein the bonded abrasive coating includes a bonding layer disposed on the distal tip and a layer of abrasive particles disposed on the bonding layer opposite the distal tip.

12. The fan blade of claim 1 wherein the bonded abrasive coating includes a bonding layer disposed on top of a layer of abrasive particles that are disposed on the distal tip.

13. A fan blade comprising: an airfoil including a leading edge, a trailing edge, a convex side, a concave side and a distal tip, wherein the leading edge, the trailing edge, the convex side and the concave side of the airfoil are only partially coated with an erosion resistant coating, wherein the erosion resistant coating terminates at a point proximal to the distal tip such that the distal tip of the airfoil is uncoated with the erosion resistant coating and the distal tip is coated with a bonded abrasive coating.

14. The fan blade of claim 13 wherein the bonded abrasive coating includes at least one material selected from the group consisting of: epoxy, polyimide, polyurethane, cyanoacrylate, acrylic and combinations thereof.

15. The fan blade of claim 13 wherein the bonded abrasive coating includes at least one abrasive material selected from the group consisting of zirconia, alumina, silica, cubic boron nitride (CBN), a metal alloy and mixtures thereof.

16. The fan blade of claim 13 wherein the bonded abrasive coating extends from the distal tip onto portions of the leading edge, trailing edge, concave side and convex side of the airfoil.

17. The fan blade of claim 16 wherein the bonded abrasive coating is rounded as it extends from the distal tip onto portions of the leading edge, trailing edge, concave side and convex side of the airfoil.

18. The fan blade of claim 16 wherein the bonded abrasive coating forms corners as it extends from the distal tip onto portions of the leading edge, trailing edge, concave side and convex side of the airfoil.

19. The fan blade of claim 13 wherein the bonded abrasive coating is rounded as it extends from the concave side to the convex side.

20. A method of fabricating a fan blade, comprising: forming an airfoil including a distal tip, partially coating the airfoil with an erosion resistant coating, wherein the erosion resistant coating terminates at a point proximal to the distal tip such that the distal tip is uncoated with the erosion resistant coating, providing a bonded abrasive on a first side of a release paper carrier, and pressing the first side of the release paper carrier onto the distal tip of the airfoil, wherein the distal tip is coated with the bonded abrasive.

* * * * *